US011419789B1

(12) United States Patent
Neuman

(10) Patent No.: US 11,419,789 B1
(45) Date of Patent: Aug. 23, 2022

(54) BLISTER PACKAGE LID

(71) Applicant: AUTOMATED ASSEMBLY CORPORATION, Lakeville, MN (US)

(72) Inventor: David Neuman, Randolph, MN (US)

(73) Assignee: AUTOMATED ASSEMBLY CORPORATION, Lakeville, MN (US)

( * ) Notice: Subject to any disclaimer, the term of this patent is extended or adjusted under 35 U.S.C. 154(b) by 205 days.

(21) Appl. No.: 16/989,598

(22) Filed: Aug. 10, 2020

Related U.S. Application Data

(62) Division of application No. 16/373,111, filed on Apr. 2, 2019, now Pat. No. 10,786,428.

(51) Int. Cl.

| | |
|---|---|
| ***A61J 1/03*** | (2006.01) |
| ***A61J 7/04*** | (2006.01) |
| ***B65D 75/36*** | (2006.01) |
| ***B65D 75/58*** | (2006.01) |

(52) U.S. Cl.
CPC ..... *A61J 1/035* (2013.01); *A61J 7/0409* (2013.01); *B65D 75/367* (2013.01); *B65D 75/5855* (2013.01); *B65D 2203/10* (2013.01); *Y10T 29/49162* (2015.01)

(58) Field of Classification Search
CPC ..... A61J 1/035; A61J 7/0409; B65D 75/367; B65D 75/5855; B65D 2203/20; Y01T 29/49162
USPC ..... 206/528, 538, 467, 469, 461; 29/846, 29/850
See application file for complete search history.

(56) References Cited

U.S. PATENT DOCUMENTS

| | | | | |
|---|---|---|---|---|
| 4,617,557 | A * | 10/1986 | Gordon | A61J 7/04 206/534 |
| 5,871,831 | A * | 2/1999 | Zeiter | A61J 7/0481 206/524.1 |
| 6,665,931 | B2 | 12/2003 | Yamaguchi et al. | |
| 7,475,784 | B2 * | 1/2009 | Simon | A61J 1/035 368/10 |
| 7,502,666 | B2 | 3/2009 | Siegel et al. | |
| 7,866,475 | B2 * | 1/2011 | Doskoczynski | B65D 75/366 206/532 |
| 8,151,990 | B2 | 4/2012 | Udo et al. | |
| 8,516,714 | B2 * | 8/2013 | Biemans | A61K 9/19 62/50.7 |
| 8,960,440 | B1 | 2/2015 | Kronberg | |

(Continued)

FOREIGN PATENT DOCUMENTS

WO 2007000407 A2 1/2007

*Primary Examiner* — Jacob K Ackun
(74) *Attorney, Agent, or Firm* — Crawford Maunu PLLC

(57) ABSTRACT

A blister package lid includes a substrate, a layer of adhesive, and a continuous pattern of electrically conductive wire disposed directly on the adhesive layer. The continuous pattern of wire has a plurality of detector segments, and the plurality of detector segments have respective destructible portions of wire at locations on the substrate corresponding to cavities of a blister sheet. Each detector segment has an outer connector portion and an inner connector portion. The outer connector portion and the inner connector portion of each detector segment are adjacent to one another, and pairs of successive first and second detector segments of the plurality of detector segments are connected by an arced segment between the inner connector portion of the first detector segment and the outer connector portion of the second detector segment.

12 Claims, 5 Drawing Sheets

(56) References Cited

U.S. PATENT DOCUMENTS

| | | | | |
|---|---|---|---|---|
| 9,636,471 | B2 | 5/2017 | Anderson et al. | |
| 9,878,139 | B2 | 1/2018 | Altschul et al. | |
| 10,010,703 | B2 | 7/2018 | Altschul et al. | |
| 10,083,594 | B2 | 9/2018 | Mehregany et al. | |
| 2003/0111477 | A1* | 6/2003 | Niemiec | H02M 7/003 221/2 |
| 2010/0089791 | A1 | 4/2010 | Rosenbaum et al. | |
| 2010/0298975 | A1* | 11/2010 | Heath | G16H 20/10 700/244 |
| 2012/0154120 | A1* | 6/2012 | Alloro | A61J 7/0481 206/528 |
| 2014/0039445 | A1 | 2/2014 | Austin et al. | |

* cited by examiner

BLISTER PACKAGE LID

FIELD OF THE INVENTION

The disclosure generally relates to blister packages.

BACKGROUND

Blister packages are sometimes used to store and deliver solid forms of medication to be taken orally. Such medications are popularly referred to as "pills" and can include tablets, capsules, caplets etc. Some blister packages have conductors that can be broken to signal removal of pills from the package. An electronic device on the blister package can sense the broken conductor and record data indicative of the event. Electronic monitoring of medicinal blister packages can be effective in protecting against tampering, ensuring delivery of proper doses at the proper times, and detecting potential misuse of medications.

A blister package commonly includes a blister sheet and lid. The blister sheet can be a plastic sheet having thermoformed pockets. The pockets are the blisters of the package and provide cavities for storage of one or more pills. The lid is attached to the blister sheet, can be easily broken for removal of the pills, and provides an air-tight and moisture-tight seal.

Current approaches to providing the conductors on the lid of a blister package have generally been expensive and have involved processes and materials that can be environmentally hazardous. For example, common approaches involve printing with conductive inks or using print-and-etch processes. Expensive chemicals can be involved and hazardous waste can be a byproduct.

SUMMARY

A disclosed blister package lid includes a substrate, a layer of adhesive, and a continuous pattern of electrically conductive wire disposed directly on the adhesive layer. The continuous pattern of wire has a plurality of detector segments, and the plurality of detector segments have respective destructible portions of wire at locations on the substrate corresponding to cavities of a blister sheet. Each detector segment has an outer connector portion and an inner connector portion. The outer connector portion and the inner connector portion of each detector segment are adjacent to one another, and pairs of successive first and second detector segments of the plurality of detector segments are connected by an arced segment between the inner connector portion of the first detector segment and the outer connector portion of the second detector segment.

A disclosed blister package includes a blister sheet having a plurality of cavities and a blister lid attached to the blister sheet. The blister lid includes a substrate and a layer of pressure-sensitive adhesive disposed on a first surface of the substrate. A pattern of electrically conductive wire is disposed directly on the adhesive layer. The wire has a circular cross-section orthogonal to a length of the wire, and the pattern has a plurality of detector segments. The plurality of detector segments have respective destructible portions of wire at locations on the substrate corresponding to the cavities of the blister sheet, and each detector segment has a first terminal end and a second terminal end. The first terminal end and the second terminal end are adjacent to one another.

The above summary of the present invention is not intended to describe each disclosed embodiment of the present invention. The figures and detailed description that follow provide additional example embodiments and aspects of the present invention.

BRIEF DESCRIPTION OF THE DRAWINGS

Other aspects and advantages of the invention will become apparent upon review of the Detailed Description and upon reference to the drawings in which.

DETAILED DESCRIPTION

Figure 1:
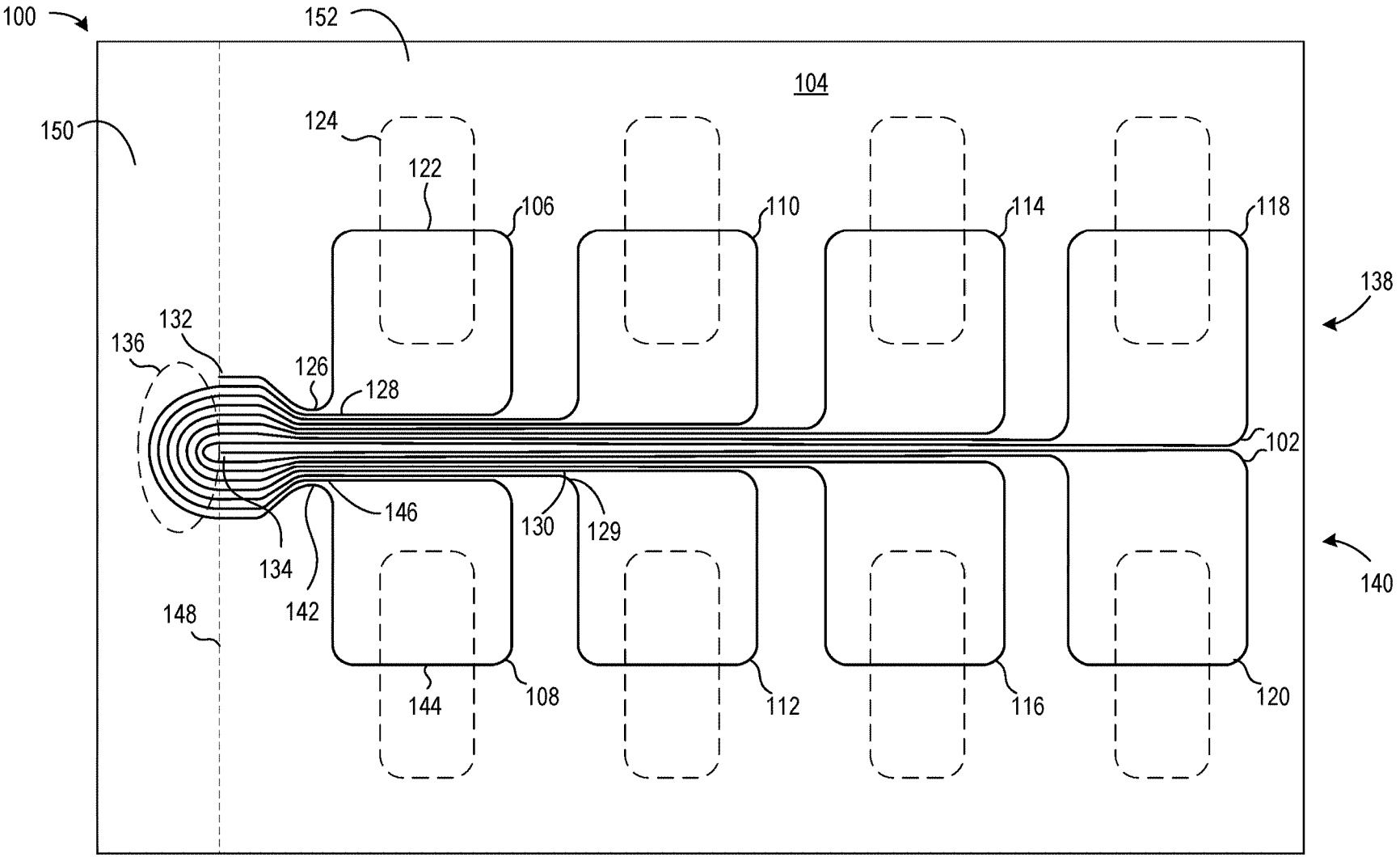
FIG. 1 shows a top view of a blister package lid having a continuous pattern of electrically conductive wire.

In the following description, numerous specific details are set forth to describe specific examples presented herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same reference numerals may be used in different diagrams to refer to the same elements or additional instances of the same element. Terms such as over, under, top, bottom, above, below, may be used herein to refer to relative positions of elements as shown in the figures. It should be understood that the terminology is used for notational convenience only and that in actual use the disclosed structures may be oriented different from the orientation shown in the figures. Thus, the terms should not be construed in a limiting manner.

The disclosed methods and structures entail inexpensive and environmentally clean approaches for providing blister packages that can be electronically monitored. Low-cost materials and processes that require fewer environmentally hazardous chemicals than prior approaches are employed to create a blister package that is reliable and economical.

The disclosed approaches involve forming a continuous pattern of electrically conductive wire on an adhesive surface of a substrate. The continuous pattern has multiple detector segments. Each detector segment has a destructible portion arranged to span a corresponding cavity in a blister sheet for a blister package. Each detector segment also has an outer connector portion and an inner connector portion that are adjacent to one another. Successive ones of the detector segments are connected in the continuous pattern of wire. The inner connector portion of the one detector segment is connected to the outer connector portion of the next successive detector segment. Once the continuous pattern of wire is laid, in one approach a connector comb can be attached to connector portions of the detector segments. Connector ends of the detector segments can be made by severing the teeth of the comb and the outer and inner connector portions that are connected to the teeth of the comb. The blister package lid can be attached to a blister sheet to form a blister package.

Further components can be attached to the blister package to enable electronic monitoring. For example, the blister package can have one or more electronic devices such as wireless transponder circuitry, memory circuits, and logic circuitry. The logic circuitry can control storage of and access to data gathered in response to breaks in the destructible portions of the wire on the blister package lid.

FIG. 1 shows a top view of a blister package lid having a continuous pattern of electrically conductive wire. The materials selected for the substrate and the wiring of the blister package lid provide a clean, economical, and reliable structure. Instead of printing and/or etching an electrically conductive pattern, a fine-gauge wire can be attached to a suitable substrate by an adhesive layer. A wide variety of substrates may be suitable as there is no need for the substrate to withstand the harsh chemicals involved in print-and-etch processes. The substrate can be material that is not cumbersome to break when removing pills from the cavities of the blister package. For some embodiments, the substrate can be paper alone, or paper or some other dielectric layer over a metallic foil for sealing the cavities.

The wire can be bare or insulated wire and made of any material suitable for the application. It will be appreciated that wire as used herein does not refer to printed or printed and/or etched patterns of conductive material. Rather, as used herein, wire refers to one or more strands of conductive material having a circular cross-section and that can be made, for example, by drawing the conductive material through draw plates.

In one embodiment, the conductor is a fine gauge bare wire. For example, 44 gauge (AWG) copper wire has been found to be suitable for some implementations. Aluminum wire may be suitable for other applications. Different metals or metal alloys and different gauges may be suitable for different blister package applications. The wire is glued to the surface of the lid with a polymer adhesive. In one embodiment, the adhesive is pressure sensitive, which keeps the wire in place as the conductive pattern is formed on the lid. Relative to a printed and/or etched conductor, the fine-gauge wiring can better maintain its integrity until the covered cavity is intentionally opened.

FIG. 1 shows an intermediate structure 100 of an exemplary lid for a blister package. The structure includes a continuous pattern of electrically conductive wire 102 disposed on a substrate 104. The formation of a continuous pattern involving round wire requires less time than would an approach in which the wire is cut after completing each detector segment, and the dispensing head moved to a new position to begin forming another detector segment. The substrate can be fully or partially covered by an adhesive layer to which the wire can be attached.

The continuous pattern of wire has multiple detector segments, and the pattern of wire on the exemplary lid has 8 detector segments 106, 108, 110, 112, 114, 116, 118, and 120. A blister package lid can have more or fewer detector segments. Each detector segment has a destructible portion that will span a corresponding cavity of a blister sheet. For example, detector segment 106 has a destructible portion 122 that spans cavity 124. Alternative patterns of destructible portions can be employed to better ensure breakage when a pill is removed from the cavity. For example, instead of a single strand of wire spanning a cavity, the destructible portion can have an S-shape or other pattern that results in multiple segments of wire spanning the cavity.

The exemplary pattern can be formed by laying wire in one pass beginning with either wire end 132 or wire end 134. A wire dispensing head can follow a path shown by the continuous pattern, dispensing wire as the wire is attached to the adhesive layer on the substrate. Each detector segment is formed to include an outer connector portion and an inner connector portion. For example, detector segment 106 has outer connector portion 126 and inner connector portion 128, and detector segment 112 has outer connector portion 129 and inner connector portion 130. The inner and outer connector portions are adjacent and parallel to one another as the connector portions extend through an arced portion 136 of the pattern and portions of the detector segments having the destructible portions (e.g., destructible portion 122).

In forming the pattern, detector segments are formed in alternating rows. The exemplary pattern includes rows 138 and 140. Detector segments are formed successively, laying wire to form a first detector segment in a first one of the rows, then laying wire to form a second detector segment in the second one of the rows, then laying wire to form a third detector segment in the first row, then laying wire to form a fourth detector segment in the second row, etc. The arced parts of the connector portions are between the first and second rows of detector segments.

In forming the detector segments, successive detector segments are connected by the inner and outer connector portions at the arced portion 136 of the pattern. For example, if detector segment 106 is formed first, the wire dispensing head traverses a path from outer connector portion 126, over destructible portion 122, to inner connector portion 128, through the arced portion 136, to outer connector portion 142 of detector segment 108, over destructible portion 144, to inner connector portion 146, and so on to detector segment 110. The order in which detector segments are formed would be reversed if formation of the pattern began at wire end 134 instead of wire end 132. Once the last detector segment has been formed in the above-described manner, wire is laid to terminate at the base of the arced portion 136, as shown by wire ends 132 and 134.

Though the exemplary wire pattern has one pair of rows of detector segments, additional pairs of rows could be made by extending the pattern from end 132 to another area of the substrate and beginning another pair of rows.

Once the continuous pattern has been formed, the structure 100 can be further processed to separate the connections between the detector segments and provide connection pads for coupling to monitoring circuitry and assembly with a blister sheet. A comb structure (see FIG. 2) can be electrically and mechanically connected to the connector portions of the detector segments, such as by solder or a conductive adhesive. The comb structure, substrate 104, and wire pattern can be severed along cut line 148. Though the exemplary cutline is orthogonal to the connector portions of the detector segments, alternative cut lines could employed to satisfy assembly requirements. Materials from the cutaway portion 150 can be recycled, and the remaining portion 152 can be used as or a part of a blister package lid in assembling a complete blister package.

Though the exemplary continuous pattern has two parallel rows of detector segments and parallel connector portions, it will be recognized that other continuous patterns can be suitable for different applications. For example, an alternative pattern could have the detector segments arranged in a circular pattern rather than a linear pattern, and the arced portion could be in the center of a circular region surrounded by the detector segments.

Figure 2:
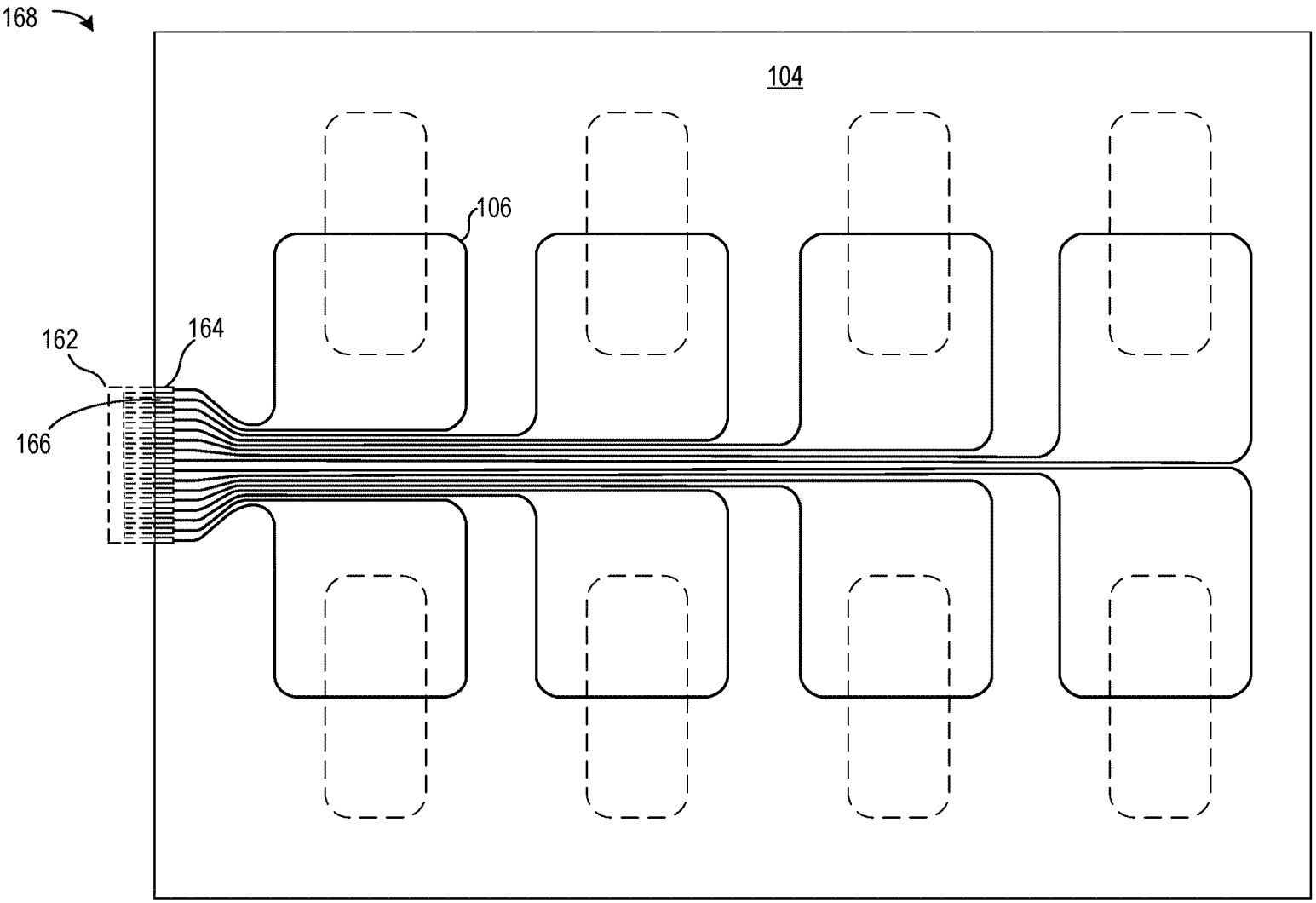
FIG. 2 shows an exemplary blister package lid having connector pads attached to terminal ends of the detector segments.

FIG. 2 shows an exemplary blister package lid having connector pads attached to terminal ends of the detector segments. The connector pads can be used in coupling the detector segments to electronic circuitry of a complete blister package.

In one approach, a comb structure 162 can be overlaid on, and the teeth of the comb structure attached and connected to the connector portions of the detector segments proximate the arced portion 136 (FIG. 1) of the continuous pattern. In FIG. 2, part of the comb structure is shown by dashed lines, and part of the comb structure is shown by solid lines. The dashed lines signify a portion of the comb structure that is severed from the substrate 104 and is not part of the completed blister package lid. Portions of the teeth of the comb remain on the substrate 104 and provide connection pads to the terminal ends of the detector segments. For example, teeth 164 and 166 provide connection pads for detector segment 106.

The comb structure can be stamped copper or other suitable conductor, for example. For jacketed wire, the jacket in areas of the connector portions can be skived to expose the conductive wire, and the teeth of the comb can be connected (e.g., solder, conductive adhesive, etc.) to the exposed wire. After soldering the comb structure to the connector portions, the comb structure, connector portions, and substrate can be cut, leaving the blister package lid 168.

Figure 3:
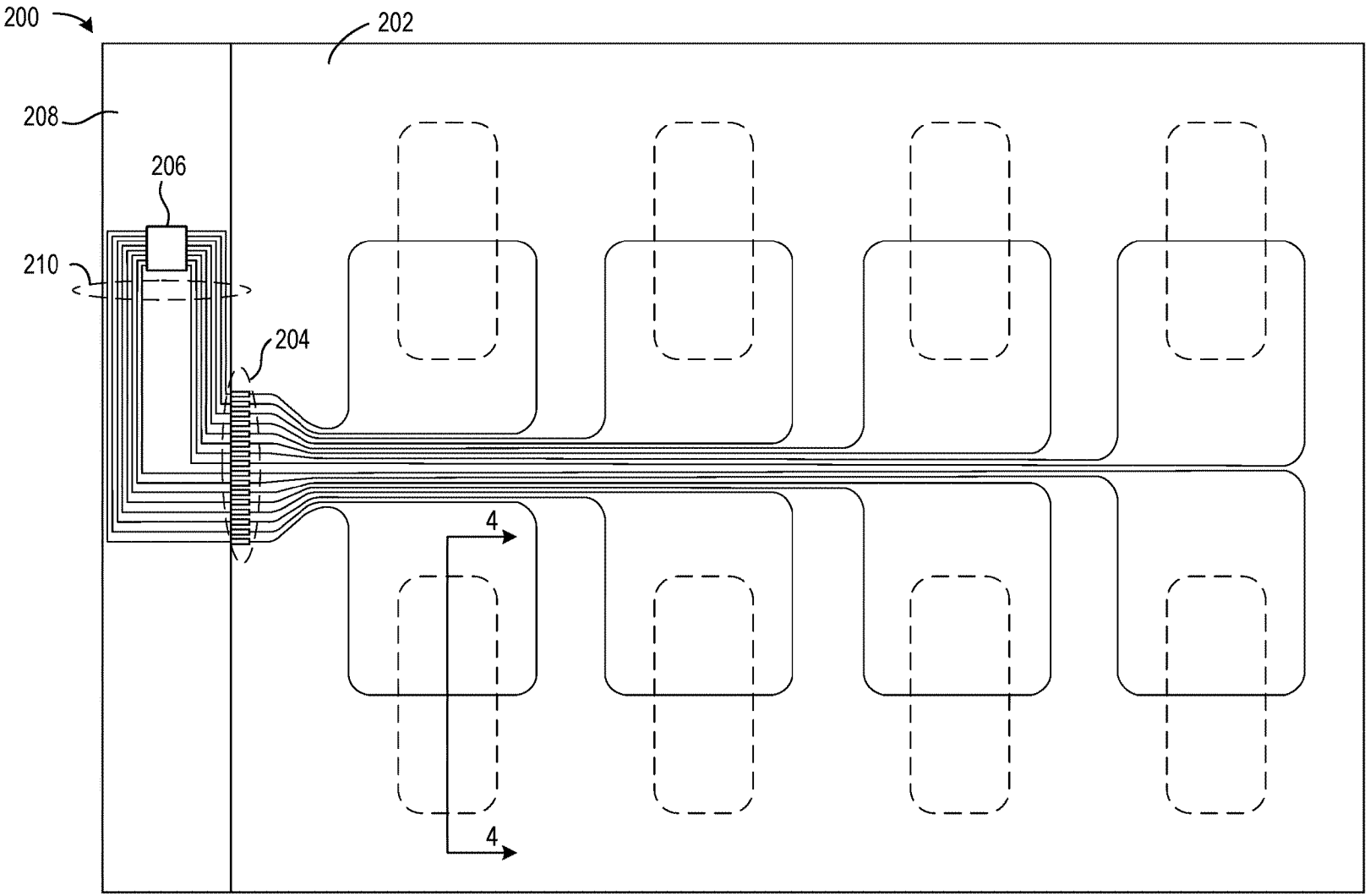
FIG. 3 shows a top view of an exemplary blister package having a blister package lid consistent with the blister package lid of FIGS. 1 and 2.

FIG. 3 shows a top view of an exemplary blister package 200 having a blister package lid 202 consistent with the blister package lid of FIGS. 1 and 2. Connector pads 204, which are connected to terminal ends of the detector segments and are remnants of the comb structure 162 (FIG. 2), are connected to one or more electronic devices 206. Exemplary electronic devices include wireless transponder circuitry, memory circuits, and logic circuitry. The logic circuitry can control storage of and access to data gathered in response to breaks in the destructible portions of the detector segments of the blister package.

The portion 208 of the blister package 200 on which the electronic device(s) 206 is disposed, along with the conductive traces 210 that connect the connector portions 204 of the detector segments to the electronic device(s) can be part of the blister sheet of the package. Alternatively, a separate carrier sheet can be attached to the blister sheet and connections made to the connector portions 204. The conductive traces 210 can be wire similar to the wire that forms the detector segments. Alternatively, the conductive traces can be printed and/or etched and be part of an integrated package to be attached as a unit to the blister sheet and connected to the blister package lid.

Figure 4:
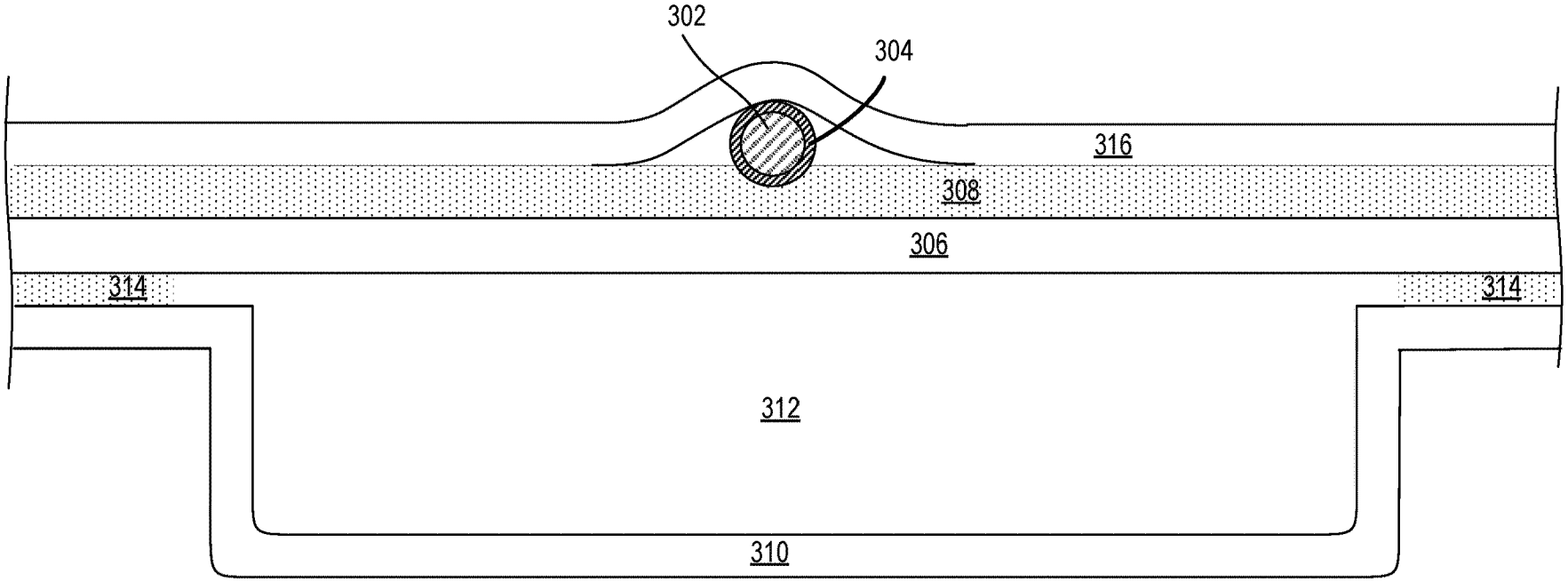
FIG. 4 shows a cross-sectional view taken in direction 4 of a portion of the blister package of FIG. 3.

FIG. 4 shows a cross-sectional view taken in direction 4 of a portion of the blister package 200 of FIG. 3. The wire 302 has a circular cross-section. The wire can be a bare wire (no insulative jacket) or a jacketed wire as shown by jacket 304. The lid of the blister package includes at least a substrate 306 and an adhesive layer 308. The adhesive layer 308 can be a pressure-sensitive adhesive. The lid can include one or more additional layers between the substrate and the blister sheet 310 and/or one or more additional layers, such as layer 316 that covers the wire, according to manufacturing and/or application requirements, or as may be needed for a dielectric layer. The blister sheet 310 has a cavity 312 formed thereon for storage of one or more pills. The blister sheet can be attached to the substrate 306 by an adhesive layer 314. Alternatively, the blister sheet can be attached to the substrate by a heat sealing process, which involves melting a plastic blister sheet to adhere to the substrate. A cover sheet 316, such as paper or foil, can be attached to the adhesive layer 308 and cover the wire 302 and the adhesive layer. The protective layer could alternatively be a release liner.

Figure 5:
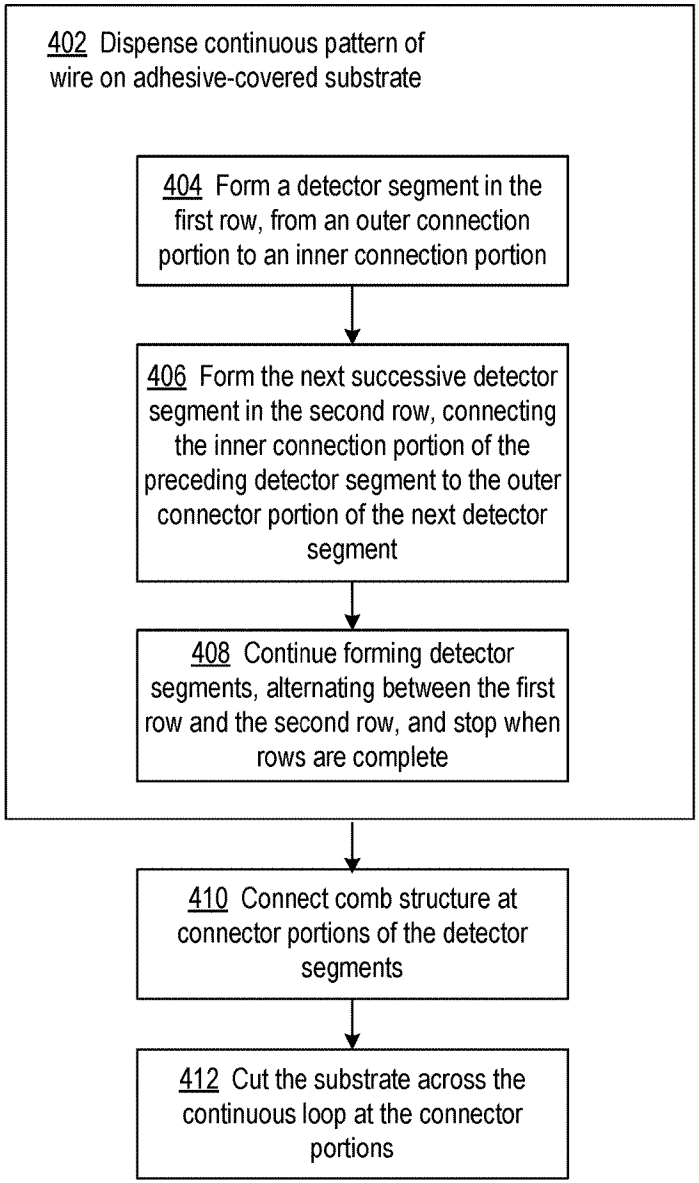
FIG. 5 shows a flowchart of an exemplary process for making a blister package lid.

FIG. 5 shows a flowchart of an exemplary process for making a blister package lid. At block 402, a continuous pattern of conductive wire is formed by dispensing wire onto a substrate having an adhesive layer. The wire can be placed on the adhesive layer by pneumatic force, mechanical force, or simply drawn by the stickiness of the adhesive as wire is fed and a wire dispensing head moves over the substrate.

In forming the continuous pattern, the process follows the pattern prescribed by blocks 404, 406, and 408. At block 404, a detector segment is formed in one of two rows by laying wire in a path from an outer connector portion, over an area that will span a cavity of a blister sheet, and to an inner connector portion of the detector segment. Next, at block 406, a successive detector segment is formed in the other of the two rows. The next detector segment is formed by laying wire that follows a path from the inner connector portion around an arced path between the one row and the other row of detector segments, continues over an outer connector portion of the successive detector segment, over an area that will span another cavity of a blister sheet, and over the inner connector portion of the successive detector segment. At block 408, the process of blocks 404 and 406 is repeated, alternating between rows in forming successive detector segments, until the desired detector segments are formed.

Once the desired detector segments have been formed in a continuous wire pattern, at block 410 a comb structure is attached at the connector portions of the detector segments. In attaching the comb structure, the jacket (if jacketed) is skived from areas of the connector portions to be connected to the comb structure, and teeth of the comb structure are mechanically and electrically bonded to the skived areas of wire on the connector portions. At block 412, the lid is severed across the substrate, teeth of the comb, and connector portions.

Though aspects and features may in some cases be described in individual figures, it will be appreciated that features from one figure can be combined with features of another figure even though the combination is not explicitly shown or explicitly described as a combination.

The present invention is thought to be applicable to a variety of blister package applications and particular applicable to blister packages for carrying medicine. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

What is claimed is:

1. A blister package lid, comprising:

a substrate;

a layer of adhesive disposed on a first surface of the substrate;

a continuous pattern of electrically conductive wire disposed directly on the layer of adhesive, the continuous pattern having a plurality of detector segments, the plurality of detector segments having respective destructible portions of wire at locations on the substrate corresponding to cavities of a blister sheet, and each detector segment having an outer connector portion and an inner connector portion;

wherein the outer connector portion and the inner connector portion of each detector segment are adjacent to one another, and pairs of successive first and second detector segments of the plurality of detector segments are connected by an arced segment between the inner connector portion of the first detector segment and the outer connector portion of the second detector segment; and a cover sheet disposed over the conductive wire and over the layer of adhesive.

2. The blister package lid of claim 1, wherein the outer and inner connector portions of the plurality of detector segments are parallel to one another.

3. The blister package lid of claim 1, wherein the plurality of detector segments are arranged in two rows, and the successive first and second detector segments are alternately disposed on the two rows of detector segments.

4. The blister package lid of claim 1, wherein the wire has a circular cross-section orthogonal to a length of the wire.

5. The blister package lid of claim 1, wherein the wire is one of copper or aluminum.

6. The blister package lid of claim 1, wherein:

the wire has a circular cross-section orthogonal to a length of the wire; and the layer of adhesive is a pressure-sensitive adhesive.

7. A blister package, comprising:

a blister sheet having a plurality of cavities; and a blister lid attached to the blister sheet, wherein the blister lid includes:

a substrate;

a layer of pressure-sensitive adhesive disposed on a first surface of the substrate;

a pattern of electrically conductive wire disposed directly on the layer of adhesive, wherein the wire has a circular cross-section orthogonal to a length of the wire, and the pattern has a plurality of detector segments, the plurality of detector segments having respective destructible portions at locations on the substrate corresponding to the cavities of the blister sheet, and each detector segment having a first terminal end and a second terminal end; and wherein the first terminal end and the second terminal end are adjacent to one another.

8. The blister package of claim 7, further comprising electronic circuitry coupled to the first terminal end and the second terminal end of each of the plurality of detector segments, the electronic circuitry configured to:

record data indicative of a breakage of any of the destructible portions; and provide wireless access to the recorded data.

9. The blister package of claim 7, wherein the plurality of detector segments are arranged in two rows.

10. The blister package of claim 7, wherein the wire has a circular cross-section orthogonal to a length of the wire.

11. The blister package of claim 7, wherein the wire is one of copper or aluminum.

12. The blister package of claim 7, wherein:

the wire has a circular cross-section orthogonal to a length of the wire; and the layer of adhesive is a pressure-sensitive adhesive.

* * * * *